US008456366B2

(12) United States Patent
Vance

(10) Patent No.: US 8,456,366 B2
(45) Date of Patent: Jun. 4, 2013

(54) COMMUNICATIONS STRUCTURES INCLUDING ANTENNAS WITH SEPARATE ANTENNA BRANCHES COUPLED TO FEED AND GROUND CONDUCTORS

(75) Inventor: Scott LaDell Vance, Staffanstorp (SE)

(73) Assignees: Sony Corporation, Tokyo (JP); Sony Mobile Communications AB, Lund (SE)

( * ) Notice: Subject to any disclaimer, the term of this patent is extended or adjusted under 35 U.S.C. 154(b) by 482 days.

(21) Appl. No.: 12/767,162

(22) Filed: Apr. 26, 2010

(65) Prior Publication Data

US 2011/0263289 A1 Oct. 27, 2011

(51) Int. Cl.
*H01Q 1/36* (2006.01)
*H01Q 1/48* (2006.01)

(52) U.S. Cl.
USPC ..... 343/700 MS; 343/702; 343/846; 343/848

(58) Field of Classification Search
USPC ..... 343/860, 905, 700 MS, 702, 846, 343/848; 455/550.1
See application file for complete search history.

(56) References Cited

U.S. PATENT DOCUMENTS

| | | | | |
|---|---|---|---|---|
| 5,434,579 | A | 7/1995 | Kagoshima et al. | |
| 5,684,492 | A | 11/1997 | Kagoshima et al. | |
| 5,926,139 | A | 7/1999 | Korisch | |
| 6,166,694 | A | 12/2000 | Ying | |
| 6,229,487 | B1 | 5/2001 | Sadler et al. | |
| 6,411,826 | B1 * | 6/2002 | Camp, Jr. | 455/566 |
| 6,535,170 | B2 | 3/2003 | Sawamura et al. | |
| 6,646,610 | B2 | 11/2003 | Troelsen | |
| 6,677,905 | B2 | 1/2004 | Deguchi et al. | |
| 6,738,023 | B2 * | 5/2004 | Scott et al. | 343/700 MS |
| 6,980,154 | B2 | 12/2005 | Vance et al. | |
| 7,015,863 | B2 * | 3/2006 | Sadler et al. | 343/702 |
| 7,053,844 | B2 * | 5/2006 | Gaucher et al. | 343/702 |
| 2002/0003499 | A1 | 1/2002 | Kouam et al. | |
| 2002/0130816 | A1 | 9/2002 | Boyle | |

(Continued)

FOREIGN PATENT DOCUMENTS

| | | |
|---|---|---|
| DE | 201 14 387 U1 | 8/2001 |
| EP | 0 777 295 | 6/1997 |

(Continued)

OTHER PUBLICATIONS

"The ARRL Antenna Book." Published 1988 by The American Radio Relay League. pp. 2-24 to 2-25.*

(Continued)

*Primary Examiner* — Jacob Y Choi
*Assistant Examiner* — Scott Petersen
(74) *Attorney, Agent, or Firm* — Myers Bigel Sibley & Sajovec

(57) ABSTRACT

A communications structure may include a ground plane, a ground conductor electrically coupled to the ground plane and extending from the ground plane, and a feed conductor. A first antenna branch may be electrically coupled to the ground conductor, with an electrical coupling between the first antenna branch and the ground conductor being spaced apart from an electrical coupling between the ground plane and the ground connector. A second antenna branch may be electrically coupled to the feed conductor, with the first and second antenna branches being spaced apart. In addition, a radio frequency (RF) transmitter and/or receiver may be provided with the ground plane and the feed conductor being electrically coupled to the RF transmitter and/or receiver.

19 Claims, 6 Drawing Sheets

U.S. PATENT DOCUMENTS

| | | | | |
|---|---|---|---|---|
| 2003/0008667 | A1* | 1/2003 | Forrester | 455/456 |
| 2003/0103010 | A1 | 6/2003 | Boyle | |
| 2003/0122717 | A1* | 7/2003 | Hood et al. | 343/702 |
| 2004/0090376 | A1* | 5/2004 | Dai et al. | 343/700 MS |
| 2004/0198293 | A1* | 10/2004 | Sadler et al. | 455/280 |
| 2005/0024273 | A1 | 2/2005 | Hayes | |
| 2011/0084889 | A1* | 4/2011 | Tsai et al. | 343/846 |

FOREIGN PATENT DOCUMENTS

| | | | |
|---|---|---|---|
| EP | 1 026 774 | A2 | 1/2000 |
| EP | 1 052 723 | A2 | 5/2000 |
| EP | 1 052 722 | | 11/2000 |
| EP | 1 154 518 | A2 | 5/2001 |
| EP | 1 168 495 | A2 | 1/2002 |
| JP | 10093332 | | 4/1998 |
| JP | 2000068736 | | 3/2000 |
| WO | WO 00/36700 | | 6/2000 |
| WO | WO 01/33665 | | 5/2001 |
| WO | WO 02/054534 | | 7/2002 |

OTHER PUBLICATIONS

Dou, Wei Ping et al., Novel Meandered Planar Inverted-F Antenna for Triple-Frequency Operation, Microwave and Optical Technology Letters, Oct. 5, 2000, pp. 58-60, vol. 27, No. 1, Singapore.

Ollikainen, Jani et al., Internal Dual-Band Patch Antenna for Mobile Phones,Helsinki University of Technology, Finland, date unknown, but for examination purposes, the date is before Dec. 17, 2002, p. 364 (4 sheets).

Wong, Kin-Lu, Chapter One, Introduction and Overview, Planar Antennas for Wireless Communications, Jan. 2003, pp. 1-25, ISBN: 0-471-26611-6.

Sager et al. "A Novel Technique to Increase the Realized Efficiency of a Mobile Phone Antenna Placed Beside a Head-Phantom," IEEE 2003.

Chiu et al., *Compact dual-band PIFA with multi-resonators*, Electronics Letters, vol. 38, No. 12, 2 sheets, Jun. 6, 2002.

Patent Abstract of Japan, vol. 1998, No. 09, Publication No. 10093331, *Microstrip Antenna System*, 1 sheet, Publication Date Oct. 4, 1998.

Invitation to Pay Additional Fees corresponding to PCT/US2004/017475 mailed on Oct. 8, 2004.

Salonen et al., "New Slot Configurations for Dual-Band Planar Inverted-F Antenna", *Microwave and Optical Technology Letters*, 28, 5 pp. 293-298 (Mar. 5, 2001).

International Search Report and Written Opinion for corresponding PCT/US2004/017475, mailing date Feb. 1, 2005.

* cited by examiner

COMMUNICATIONS STRUCTURES INCLUDING ANTENNAS WITH SEPARATE ANTENNA BRANCHES COUPLED TO FEED AND GROUND CONDUCTORS

FIELD OF THE INVENTION

The present invention relates to the field of electronics, and more particularly to antennas for communications structures.

BACKGROUND

Sizes of wireless radiotelephone communications terminals (also referred to as mobile terminals) has been decreasing with many contemporary terminals being less than 11 centimeters in length. Correspondingly, there is increasing interest in small antennas that can be used as internally mounted antennas for such terminals.

Moreover, it may be desirable for a wireless radiotelephone communication terminal to operate within multiple frequency bands, for example, to allow use of more than one communications system/standard. For example, Global System for Mobile communication (GSM) is a digital mobile telephone system that may typically operate at a relatively low frequency band, such as between 824 MHz and 894 MHz and/or between 880 MHz and 960 MHz. Code Division Multiple Access is another digital mobile telephone system that may operate at frequency bands such as between 1710 MHz and 1755 MHz band and/or between 2110 MHz and 2170 MHz. Digital Communications System (DCS) is a digital mobile telephone system that may typically operate at relatively high frequency bands, such as between 1710 MHz and 1880 MHz. Personal Communication Services (PCS) is a digital mobile telephone system that may operate at frequency bands between 1850 MHz and 1990 MHz. In addition, global positioning systems (GPS) and/or Bluetooth systems may use frequencies of 1.575 and/or 2.4-2.48 GHz. Other frequency bands may be used in other jurisdictions. Accordingly, internal antennas are being provided for operation at multiple frequency bands.

SUMMARY

According to some embodiments of the present invention, a communications structure may include a ground plane, a ground conductor electrically coupled to the ground plane and extending from the ground plane, and a feed conductor. A first antenna branch may be electrically coupled to the ground conductor with an electrical coupling between the first antenna branch and the ground conductor being spaced apart from an electrical coupling between the ground plane and the ground connector. A second antenna branch may be electrically coupled to the feed conductor with the first and second antenna branches being spaced apart.

Moreover, a radio frequency (RF) transmitter and/or receiver may be provided with the ground plane and the feed conductor being electrically coupled to the RF transmitter and/or receiver. A segment of the first antenna branch may be parallel with respect to and spaced apart from the ground conductor, and/or the second antenna branch may include a first segment orthogonal with respect to the segment of the first antenna branch and a second segment parallel with respect to the segment of the first antenna branch.

A length of the second antenna branch may be greater than a length of the first antenna branch. A third antenna branch may be electrically coupled to the feed conductor, with a segment of the third antenna branch being parallel with respect to the first antenna branch. The third antenna branch may include first and second segments coupled through an impedance matching element, and with a length of the third antenna branch including the first and second segments being greater than a length of the second branch. The impedance matching element may be an inductive element such as a discrete inductive element and/or a tight meander pattern in third antenna branch.

The ground plane, the ground conductor, and the second antenna branch may be provided in a first plane, and the first and third antenna branches may be provided in a second plane spaced apart from the first plane. The first and second planes may be spaced apart by at least about 4 mm, and the first and second planes may be parallel. The first, second, and third antenna branches may be confined within a volume of no more than about 60 mm by 10 mm by 10 mm, and according to some embodiments within a volume of no more than about 8 mm by 9 mm by 50 mm. The third antenna branch may be configured to resonate at frequencies less than about 960 MHZ (e.g., in a range of about 824 MHz to about 960 MHz) and at frequencies greater than about 2.3 GHz (e.g., in a range of about 2.3 GHz to about 2.7 GHz).

The first antenna branch may be configured to resonate at frequencies in a range of about 2 GHz to about 2.3 GHz. The second antenna branch may be configured to resonate at frequencies in a range of about 1.7 GHz to about 2.0 GHz.

An impedance matching line may be electrically coupled between the ground plane and the second antenna segment, with a length of the impedance matching line having a length of at least about 10 mm (e.g., in a range of about 10 nm to about 25 mm). A cross-sectional current conduction area of the ground conductor may be at least twice a cross-sectional current conduction area of the impedance matching line. A width of the impedance matching line may be no more than about 1.5 mm (e.g., in a range of about 0.2 mm to about 0.8 mm). A segment of the impedance matching line may be parallel with respect to the ground conductor, and the segment of the impedance matching line may be spaced apart from the ground conductor by at least about 2 mm.

The feed conductor may include an inner conductor of a coaxial RF feed structure, and the ground conductor may include an outer conductor of the coaxial RF feed structure so that a portion of the ground conductor surrounds a portion of the feed conductor. In addition, a tubular insulating layer of the coaxial RF feed structure may separate the feed and ground conductors. The coaxial RF feed structure including the inner and outer conductors may provide a 50 ohm impedance. A length of the outer conductor of the coaxial RF feed structure which extends beyond the edge of the ground plane may be in the range of about 3 mm to about 25 mm (e.g., about 10 mm).

In addition, an RF transceiver may include an RF transmitter coupled to the feed conductor and an RF receiver coupled to the feed conductor. A user interface may include a speaker and a microphone, and a processor may be coupled between the user interface and the transceiver. The processor may be configured to receive radiotelephone communications through the receiver and to reproduce audio communications using the speaker responsive to the received radiotelephone communications, and to generate radiotelephone communications for transmission through the transmitter responsive to audio input received through the microphone.

A printed circuit board (PCB) may include electrically conductive traces provided at different planes thereof, with portions of the processor, user interface, and/or transceiver implemented as electronic components (e.g., integrated circuit devices and/or discrete electronic devices such as resistors, capacitors, inductors, transistors, diodes, etc.) provided on the printed circuit board. In addition, the ground plane may be provided as an electrically conductive layer at one or more planes of the printed circuit board.

DETAILED DESCRIPTION

Figure 1:
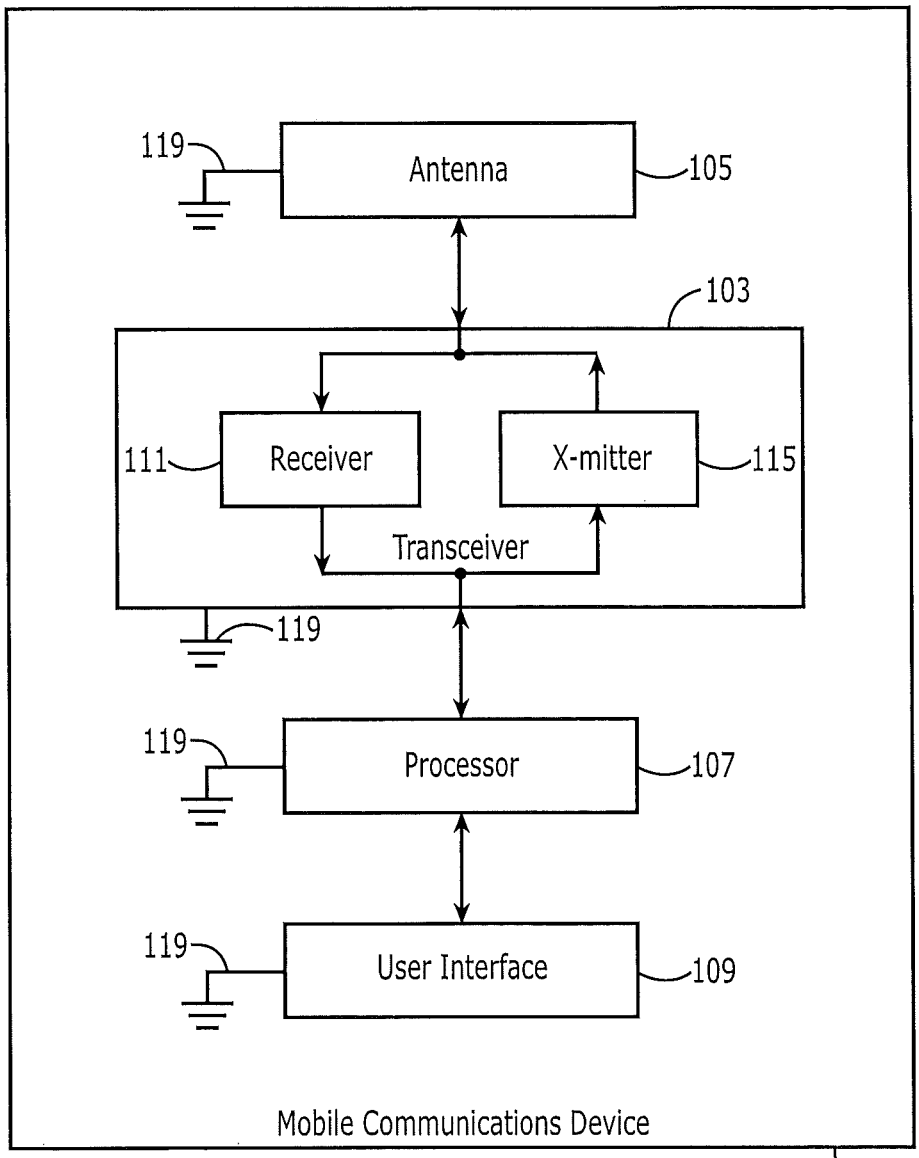
FIG. 1 is a block diagram illustrating communications structures according to some embodiments of the present invention.

Embodiments of the invention will now be described more fully hereinafter with reference to the accompanying drawings, in which embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art.

It will be understood that, when an element is referred to as being "coupled" or "connected" to another element, it can be directly coupled or connected to the other element or intervening elements may be present. In contrast, when an element is referred to as being "directly coupled" or "directly connected" to another element, there are no intervening elements present. Like numbers refer to like elements throughout.

Spatially relative terms, such as "above", "below", "upper", "lower" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" other elements or features would then be oriented "above" the other elements or features. Thus, the exemplary term "below" can encompass both an orientation of above and below. The device may be otherwise oriented (rotated 90 degrees or at other orientations) and the spatially relative descriptors used herein interpreted accordingly. Well-known functions or constructions may not be described in detail for brevity and/or clarity.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of this specification and the relevant art and will not be interpreted in an idealized or overly formal sense unless expressly so defined herein.

Embodiments of the invention are described herein with reference to schematic illustrations of idealized embodiments of the invention. As such, variations from the shapes and relative sizes of the illustrations as a result, for example, of manufacturing techniques and/or tolerances, are to be expected. Thus, embodiments of the invention should not be construed as limited to the particular shapes and relative sizes of regions illustrated herein but are to include deviations in shapes and/or relative sizes that result, for example, from different operational constraints and/or from manufacturing constraints. Thus, the elements illustrated in the figures are schematic in nature and their shapes are not intended to illustrate the actual shape of a region of a device and are not intended to limit the scope of the invention.

For purposes of illustration and explanation only, various embodiments of the present invention are described herein in the context of multiband wireless ("mobile") communication terminals ("wireless terminals" or "terminals") that are configured to carry out cellular communications (e.g., cellular voice and/or data communications) in more than one frequency band. It will be understood, however, that the present invention is not limited to such embodiments and may be embodied generally in any wireless communication terminal that includes a multiband RF antenna that is configured to transmit and receive in two or more frequency bands.

As used herein, the term "multiband" can include, for example, operations in any of the following bands: Advanced Mobile Phone Service (AMPS), ANSI-136, Global Standard for Mobile (GSM) communication, General Packet Radio Service (GPRS), enhanced data rates for GSM evolution (EDGE), DCS, PDC, PCS, code division multiple access (CDMA), wideband-CDMA, CDMA2000, and/or Universal Mobile Telecommunications System (UMTS) frequency bands. GSM operation may include transmission in a frequency range of about 824 MHz to about 849 MHz and reception in a frequency range of about 869 MHz to about 894 MHz. EGSM operation may include transmission in a frequency range of about 880 MHz to about 914 MHz and reception in a frequency range of about 925 MHz to about 960 MHz. DCS operation may include transmission in a frequency range of about 1710 MHz to about 1785 MHz and reception in a frequency range of about 1805 MHz to about 1880 MHz. PDC operation may include transmission in a frequency range of about 893 MHz to about 953 MHz and reception in a frequency range of about 810 MHz to about 885 MHz. PCS operation may include transmission in a frequency range of about 1850 MHz to about 1910 MHz and reception in a frequency range of about 1930 MHz to about 1990 MHz. UMTS operation may include transmission/reception using Band 1 (between 1920 MHz and 1980 MHz and/or between 2110 MHz and 2170 MHz); Band 4 (between 1710 MHz and 1755 MHz and/or between 2110 MHz and 2155 MHz); Band 38 (china: between 2570 MHz and 2620 MHz); Band 40 (china: between 2300 MHz and 2400 MHz); and BT/WLAN (between 2400 MHz and 2485 MHz). Other bands can also be used in embodiments according to the invention. For example, antennas according to some embodiments of the present invention may be tuned to cover additional frequencies such as bands 12, 13, 14, and/or 17 (e.g., between about 698 MHz and 798 MHz). Antennas according to some embodiments of the present invention may be tuned to also cover 1575 MHz GSM, and in such embodiments, a diplexer may be used separate GSM signals (from other signals) for processing in a separate GSM receiver.

FIG. 1 is a block diagram of a wireless communications terminal 101 (such as a mobile radiotelephone) according to some embodiments of the present invention. Wireless communications terminal 101 may include RF (radio frequency) transceiver 103 coupled between antenna 105 and processor 107. In addition, user interface 109 may be coupled to processor 107, and user interface 109 may include a speaker, a microphone, a display (e.g., an LCD screen), a touch sensitive input (e.g., a touch sensitive display screen, a touch sensitive pad, etc.), a keypad, etc. As further shown in FIG. 1, transceiver 103 may include receiver 111 and transmitter 115, but some embodiments of the present invention may include only a receiver or only a transmitter. Accordingly, processor 107 may be configured to receive radiotelephone communications through receiver 111 and to reproduce audio communications using a speaker of user interface 109 responsive to the received radiotelephone communications, and/or to generate radiotelephone communications for transmission through transmitter 115 responsive to audio input received through the microphone of user interface 109.

Moreover, portions of antenna 105, processor 107, user interface 109, and/or transceiver 103 may be implemented as electronic components (e.g., integrated circuit and/or discrete electronic devices such as resistors, capacitors, inductors, transistors, diodes, etc.) provided on a printed circuit board (PCB) or boards. Moreover, the printed circuit board(s) may include electrically conductive traces at a plurality of different planes thereof providing electrical coupling between electronic components thereon, and an electrical ground plane may be provided as an electrically conductive layer at one or more planes of the printed circuit board. As shown in FIG. 1, each of antenna 105, transceiver 103, processor 107, and/or user interface 109 may be electrically coupled to a common ground plane as indicated by ground symbols 119.

As discussed in greater detail below, antenna 105 may include a plurality of branches to provide resonances at different frequency bands, such as at frequencies less than about 960 MHZ (e.g. in the range of about, 824 MHz to about 960 MHz), at frequencies in the range of about 1.7 GHz to about 2.0 GHz, at frequencies at frequencies in the range of about 2 GHz to about 2.3 GHz, and/or at frequencies greater than about 2.3 GHz (e.g., in the range of about 2.3 GHz to about 2.7 GHz). Moreover, antenna 105 may be confined within a volume of no more than about 60 mm by 10 mm by 10 mm (e.g., within a volume of about 50 mm by 9 mm by 8 mm).

Figure 2A:
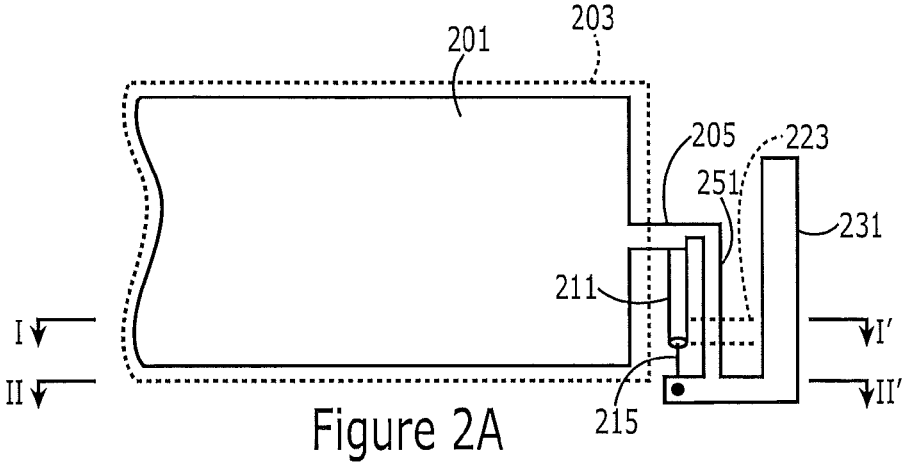
FIGS. 2A to 2D are plan and cross sectional views of antenna structures according to some embodiments of the present invention.
Figure 2B:
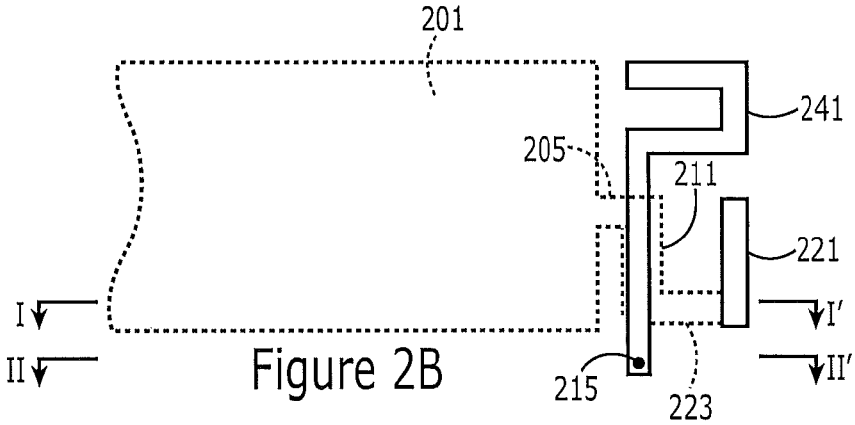
Figure 2C:
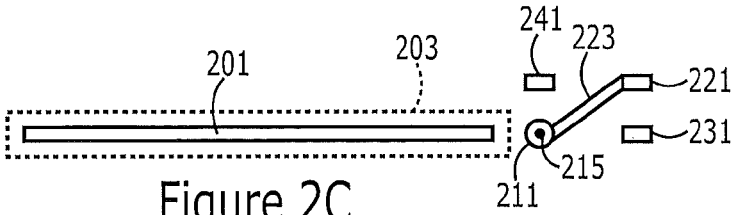
Figure 2D:
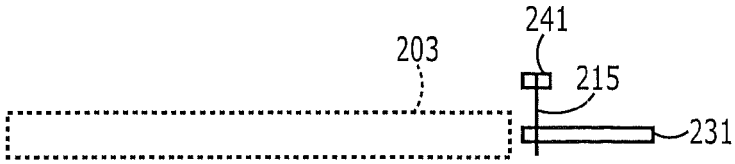

FIGS. 2A and 2B are plan views illustrating antenna structures of wireless communications terminal 101 of FIG. 1 taken at different planes, and FIGS. 2C and 2D are cross sectional views respectively taken at sections lines I-I' and of FIGS. 2A and 2B. Electrical ground plane 201 of printed circuit board 203 is shown in FIGS. 2A and 2C in solid lines, and in FIG. 2B in dotted lines. Printed circuit board 203 is shown in dotted lines in FIGS. 2A, 2C, and 2D. Ground plane 201 is shown in dotted lines in FIG. 2B because it is out of the plane being illustrated, and ground plane 201 is omitted from FIG. 2D for clarity. PCB 203 is illustrated in dotted lines in FIGS. 2A, 2C, and 2D, and PCB 203 is omitted from FIG. 2B for clarity. Elements of the antenna structure may be illustrated in dotted lines if the element is not in the plane being illustrated.

As shown in FIGS. 2A to 2D, a radio frequency (RF) feed structure may include ground conductor 211 extending from and electrically coupled to ground plane 201 (shown as ground symbol 119 of FIG. 1) and feed conductor 215 electrically coupled to transceiver 115 of FIG. 1. According to some embodiments of the present invention, feed conductor 215 may be an inner conductor of a coaxial RF feed structure, and ground conductor 211 may be an outer conductor of the coaxial RF feed structure so that a portion of ground conductor 211 surrounds a portion of feed conductor 215. In such a coaxial RF feed structure, a tubular insulating layer of the coaxial RF feed structure may separate feed and ground conductors 215 and 211, and feed conductor 215 may extend beyond ground conductor 215 to provide electrical coupling with one or more antenna branches. According to some embodiments of the present invention, a coaxial RF feed structure including feed and ground conductors 215 and 211 may provide a 50 ohm impedance. While a coaxial feed structure is shown by way of example, other feed structures, such as printed line feed structures may be used.

As shown in FIG. 2A, ground conductor 211 may be spaced apart from ground plane 201, and ground conductor 211 may be provided in a direction that is parallel with respect to closest adjacent edges of ground plane 201 and/or PCB 203, with an electrical coupling to ground plane 201 (e.g., extension 205 of ground plane 201) provided at one end of ground conductor 211. Ground conductor 211, for example, may extend from an electrical coupling with ground plane 201 (e.g., from extension 205) in the direction parallel to the closest adjacent edge of the ground plane a length of at least about 3 mm, and according to some embodiments, at least about 10 mm. For example, ground conductor 211 may extend from extension 205 a length in the range of about 3 mm to about 25 mm (e.g., about 10 mm).

Antenna branch 221 may be electrically coupled to ground conductor 211 through conductor 223 as shown in FIGS. 2A, 2B, and 2C. As shown in FIG. 2C, ground conductor 211 and antenna branch 221 may be provided in different planes so that conductor 223 crosses different planes. While conductor 223 is shown by way of example providing a diagonal connection, conductor 223 may be provided, for example, using one or more horizontal and/or vertical conductors (e.g., horizontal traces parallel with respect to a plane of ground plane 201 and vertical vias perpendicular with respect to a plane of ground plane 201). Antenna branch 221, for example, may be configured to resonate at frequencies in the range of about 2 GHz to about 2.3 GHz.

Moreover, electrical coupling 223 between antenna branch 221 and ground conductor 211 may be spaced apart from an electrical coupling between ground plane 201 and ground connector 211 (e.g., at extension 205 of ground plane 201). According to some embodiments, electrical coupling 223 may be spaced apart from extension 205 of ground plane by a distance of at least about 3 mm, and according to some embodiments, by a distance of at least about 10 mm. For example, electrical coupling 223 may be spaced apart from extension 205 by a distance in the range of about 3 mm to about 25 mm (e.g., about 10 mm). Accordingly, antenna branch 221 and ground conductor 211 may both be parallel with respect to closest adjacent edges of ground plane 201 and/or PCB 203. In addition, a length of a segment of antenna branch 221 may be parallel with respect to and spaced apart from the ground conductor 211.

Ground conductor 211 may thus provide a partially floating ground that is connected galvanically through electrical coupling 223 to antenna branch 221 at only one end thereof so that a length of ground conductor 211 between ground plane extension 205 and electrical coupling 223 may be at least about 3 mm, and according to some embodiments, at least about 10 mm. According to some embodiments, a length of ground conductor 211 between ground plane extension 205 and electrical coupling 223 may be in the range of about 3 mm to about 25 mm, and according to some embodiments, the length may be about 10 mm.

Because an end portion (spaced apart from an electrical connection with ground plane 201) of ground conductor 211 may float electrically, currents may flow on/through ground conductor 211 of the coax feed structure. A length of ground conductor 211 (extending from an electrical connection with ground plane 201) may be tuned so that currents flow primarily in high-band frequencies, and resonances (¼ wave) at these high-band frequencies may be established. Accordingly, antenna branch 221 may be electrically connected to the floating end portion of ground conductor 211 (through conductor 223) to couple directly into the RF system. Because currents in the low-band may be negligible along a length of ground conductor 211, degradation in the low-band from antenna branch 221 may be insignificant.

Antenna branch 231 may be electrically coupled to feed conductor 215 as shown in FIGS. 2A, 2B, and 2D. Moreover, antenna branch 231 may include a first segment orthogonal with respect to antenna branch 221 and a second segment parallel with respect to antenna branch 221. A length of antenna branch 231 may be greater than a length of antenna branch 221, and according to some embodiments, a length of the second segment of antenna branch 231 (that is parallel with respect to antenna branch 221) may be greater that a length of antenna segment 221. Moreover, antenna segment 221 may be aligned with the second segment of antenna branch 231 in a direction that is perpendicular with respect to a plane of ground plane 201.

In addition, impedance matching line 251 may be electrically coupled between antenna branch 231 and ground plane 201 and/or ground plane extension 205. Moreover, a length of impedance matching line 251 in a direction parallel with respect to a closest adjacent edge of ground plane 201 and/or PCB 203 may be at least as great as a length of ground conductor 211 in the same direction, and as shown in FIG. 2A, a length of impedance matching line 251 may be greater than that of ground conductor 211. Impedance matching line 251 may be at least about 3 mm long in the direction parallel with respect to the closest adjacent edge of ground plane 201 and/or PCB 203, and according to some embodiments, at least about 10 mm in the direction parallel with respect to the closest adjacent edge of ground plane 201. For example, impedance matching line 251 may have a length in the direction parallel with respect to ground conductor 211 in the range of about 10 mm to about 20 mm. Antenna branch 231, for example, may be configured to resonate at frequencies in the range of about 1.7 GHz to about 2.0 GHz.

Moreover, a cross-sectional current conduction area of ground conductor 211 may be at least twice a cross-sectional current conduction area of impedance matching line 251 wherein the cross-sectional current conduction areas are taken in a plane that is perpendicular with respect to ground plane 201 and perpendicular with respect to a closest adjacent edge of PCB 203 and/or ground plane 201. A width of impedance matching line 251 (in a direction perpendicular with respect to its length and parallel with respect to ground plane 201) may be no more than about 1.5 mm, and according to some embodiments, may be in the range of about 0.1 mm to about 1.5 mm, in the range of about in the range of 0.2 mm to about 0.8 mm, or even in the range of about 0.3 mm to about 0.4 mm. A segment of impedance matching line 251 may be parallel with respect to ground conductor 211, and the parallel segment of impedance matching line 251 may be spaced apart from ground conductor 211 by at least about 2 mm. For example, parallel portions of impedance matching line 251 and ground conductor 211 may be spaced apart by about 2 mm to about 5 mm. According to some embodiments of the present invention, parallel portions of impedance matching line 251 and ground conductor 211 may be spaced apart by about 3 mm, and parallel portions of ground conductor 211 and an adjacent edge of ground plane 201 may be spaced apart by about 3 mm. Accordingly, parallel portions of impedance matching line 251 and an adjacent edge of ground plane 201 may be spaced apart by at least about 4 mm, and according to some embodiments may be spaced apart in the range of about 4 mm to about 6 mm. Impedance matching line 251 of FIG. 2A may improve matching for low-band frequencies without significantly impacting high-band frequency performance.

Impedance matching line 251 and antenna branch 231 may be provided in a same plane as shown in FIG. 2A. For example, impedance matching line 251 and antenna branch 231 may be formed/bonded to an insulating surface of a same substrate. Impedance matching line 251 and antenna branch 231 may be formed, for example, by printing, photolithography/etch, stamping, etc.

Antenna branch 241 may be electrically coupled to feed conductor 215 as shown in FIGS. 2B, 2C, and 2D, and at least a segment of antenna branch 241 may be parallel with respect to antenna branch 221. Moreover, antenna branches 221 and 241 may be provided in a same plane that is parallel to and spaced apart from a plane of ground plane 201. For example, ground plane 201, ground conductor 211, and antenna branch 231 may be provided in a first plane, and antenna branches 221 and 241 may be provided in a second plane spaced apart from (and parallel with respect to) the first plane. The first and second planes may be spaced apart by at least about 4 mm. Moreover, feed conductor 215 may extend beyond ground conductor 211 in the direction parallel to the closest adjacent edge of ground plane 201 and/or PCB 203 to antenna branch 231 (as shown in FIGS. 2A and 2C), and then bend 90 degrees to extend through/to antenna branches 231 and 241. In the structure(s) of FIGS. 2A to 2D, antenna branches 221, 231, and 241 may be confined, for example, within a volume of no more than about 60 mm by 10 mm by 10 mm, and according to some embodiments, within a volume of no more than about 8 mm by 9 mm by 50 mm.

Antenna branch 241 may include first and second segments coupled through an impedance matching element (e.g., an inductive matching element), and a length of antenna branch 241 (including the first and second segments) may be greater than a length of antenna branch 231. The impedance matching element may be placed at a position along antenna branch 241 that is about ⅓ of the distance from the coupling with feed conductor 215 toward an opposite end of antenna branch 241.

Figure 3:
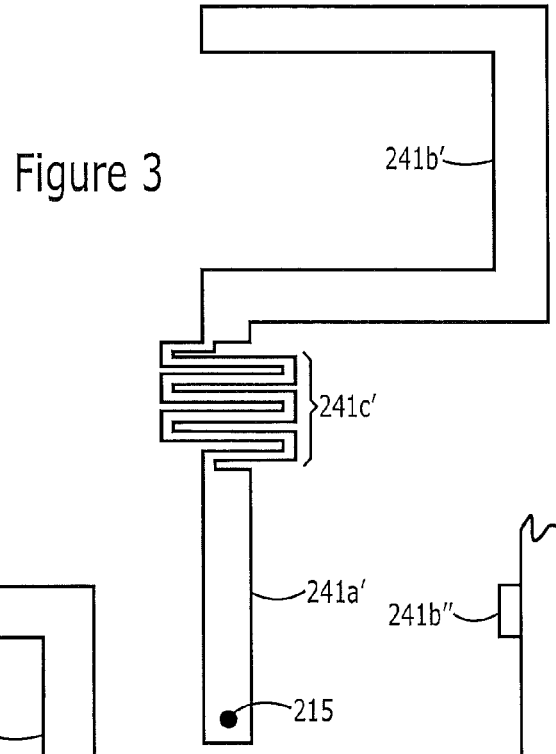
FIG. 3 is a plan view of a first alternative of a longest antenna branch of FIGS. 2A-2D according to some embodiments of the present invention.

FIG. 3 is a greatly enlarged plan view of some embodiments of antenna branch 241 including segments 241*a*' and 241*b*' coupled through an impedance matching element provided using an inductive meander pattern 241*c*'. As shown in FIG. 3, segments 241*a*' and 241*b*' and inductive meander pattern 241*c*' may be formed as a continuous planar metal pattern formed by printing, photolithography/etch, stamping, etc. While not shown in FIG. 3, antenna branch 241 (including segments 241*a*' and 241*b*' and inductive meander pattern 241*c*') may be formed on and/or bonded to an electrically insulating surface of a support substrate, and antenna branches 241 and 221 may be formed on and/or bonded to a same electrically insulating surface of a support substrate. Inductive meander pattern 241*c*' may be provided at a position along antenna branch 241 that is about ⅓ of the distance from the coupling with feed conductor 215 toward an opposite end of antenna branch 241. Stated in other words, a length of segment 241*b*' may be about 2 times greater than a length of segment 241*a*'.

Figure 4A:
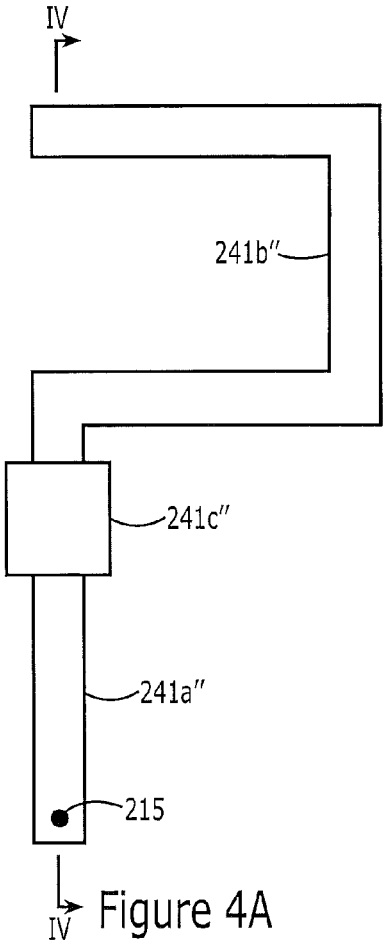
FIGS. 4A and 4B are respective plan and cross sectional views of a second alternative of a longest antenna branch of FIGS. 2A-2D according to some embodiments of the present invention.
Figure 4B:
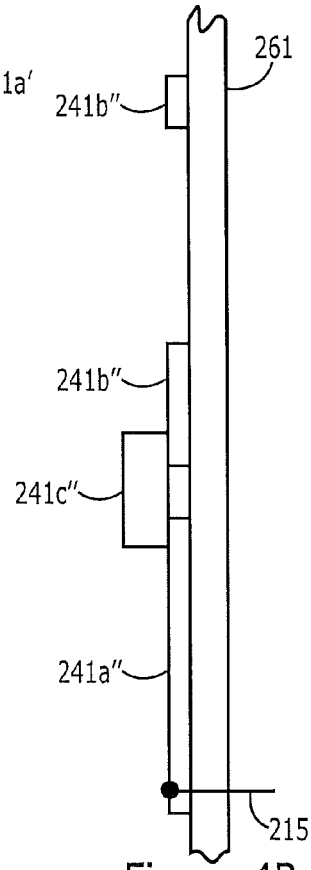

FIGS. 4A and 4B are respective plan and cross-sectional views of some embodiments of antenna branch 241 including segments 241*a*" and 241*b*" coupled through an impedance matching element provided using a discrete inductive element 241*c*", Antenna branch 241 (including segments 241*a*" and 241*b*") may be formed (e.g., by printing and/or photolithography/etch) on an insulating surface of support substrate 261, and first and second leads of discrete inductive element 241*c*" (e.g., a surface mount inductor) may be respectively soldered to segments 241*a*" and 241*b*". Segments 241*a*" and 241*b*" may be formed by printing, photolighography/etch, stamping, etc. While not shown in FIGS. 4A and 4B, segments 241*a*" and 241*b*" (of antenna branch 241) and antenna branch 221 may be formed on and/or bonded to a same electrically insulating surface of support substrate 261. Discrete inductive element 241*c*" may be provided at a position along antenna branch 241 that is about ⅓ of the distance from the coupling with feed conductor 215 toward an opposite end of antenna branch 241. Stated in other words a length of segment 241*b*" may be about 2 times greater than a length of segment 241*a*".

By providing segments of antenna branch 241 separated by an inductive element, antenna branch 241 may be configured to resonate at frequencies less than about 960 MHZ and at frequencies greater than about 2.3 GHz. For example, antenna branch 241 may be configured to resonate at frequencies in the range of about 824 MHz to about 960 MHz and at frequencies in the range of about 2.3 to about 2.7 GHz. In other words, antenna branch 241 may have a harmonic resonance (e.g., 3×800 MHz) which resonates at frequencies in the range of about 2.3 GHz to about 2.7 GHz.

For low band frequencies (e.g., at about 824 MHz to about 960 MHz), currents along a length of antenna branch 241 may be highest at a feed end adjacent feed conductor 215 and lowest at an opposite end of antenna branch 241 spaced apart from feed conductor 215. For high band frequencies (e.g., at about 2.3 GHz to about 2.7 GHz), a first current peak may occur on antenna element 241 adjacent feed conductor 215, a first current null may occur at about ⅓ of the distance along antenna branch 241 from feed conductor 215, a second current peak may occur between the first current null and the end of antenna branch 241 opposite feed conductor 215, and a second current null may occur at an end of antenna branch 241 opposite feed conductor 215. By positioning an inductive matching element about ⅓ of the distance along antenna branch from feed conductor 215 as discussed above with respect to FIGS. 3, 4A, and 4B, the inductive matching element may be used to influence the low band frequencies without significantly impacting high-band frequencies where currents may be substantially zero.

Figure 5:
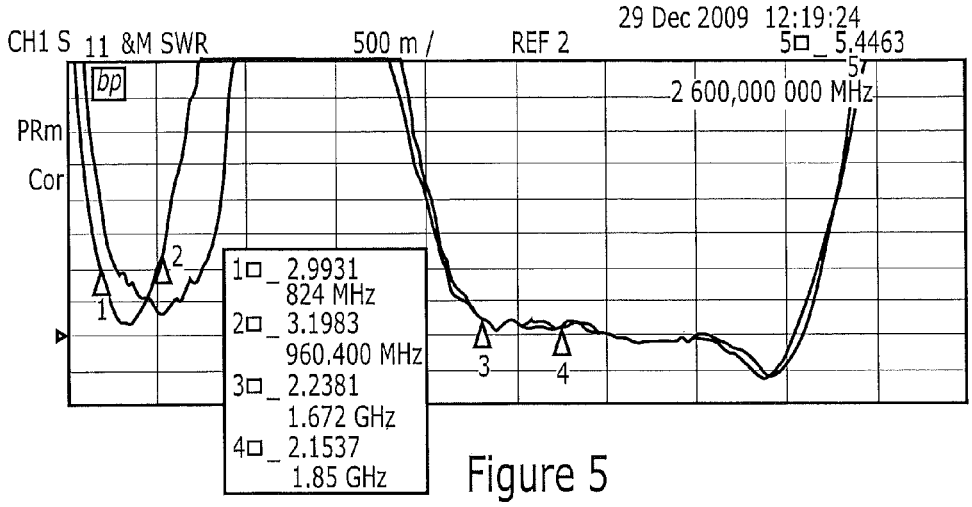
FIGS. 5 and 6 are graphs illustrating changes in antenna characteristics resulting from changes in antenna length and/or impedance matching components.

A length of antenna branch 241 may thus be determined to provide the high-band frequencies, and then, an inductive matching element may be provided to adjust the low-band frequencies. FIG. 5 is a VSWR (voltage standing wave ration) plot illustrating use of an inductive matching element to tune antenna branch 241 as discussed above. The two plots of FIG. 5 illustrate performance of antenna branch 241 without an inductive matching element (with the higher of the two low-band frequencies) and with a 4.7 nH inductor (with the lower of the two low-band frequencies). As shown in FIG. 5, high band performance may not change significantly with or without the inductor.

To further tune antenna branch 241, an inductance provided by the inductive matching element may be increased and a length of antenna branch 241 may be reduced to shift the high band resonance without significantly changing the low band resonance. A length of antenna branch 241 was reduced by about 4 mm (relative to the structure used to generate the graph of FIG. 5), and an inductance of the inductive matching element was increased from about 4.7 nH to about 6.8 nH to provide resonances illustrated in the graph of FIG. 6. According to some embodiments of the present invention, high-band bandwidth may be increased (at the high end) by about 100 MHz to about 200 MHz.

Without an inductive matching element, antenna branch 241 may normally resonate at about 2.5 times its primary frequency (e.g., at about 2.5×960 MHz or at about 2.4 GHz). By providing an inductive element along a length of antenna branch 241 as discussed above with respect to FIGS. 2B, 3A, 3B, 4, 5, and 6, antenna branch 241 may be configured to resonate at a higher multiple of the primary frequency (e.g., at about 3 times the primary frequency). According to some embodiments of the present invention, antenna branch 241 may be configured to resonate at frequencies in the range of about 824 MHz to about 960 MHz and at frequencies in the range of about 2.3 to about 2.7 GHz. An inductive matching element may thus be used to shift the higher harmonic frequency band higher without significantly impacting the lower frequency band when used in conjunction with a reduction in length of the 241*b*" element.

Figure 6:
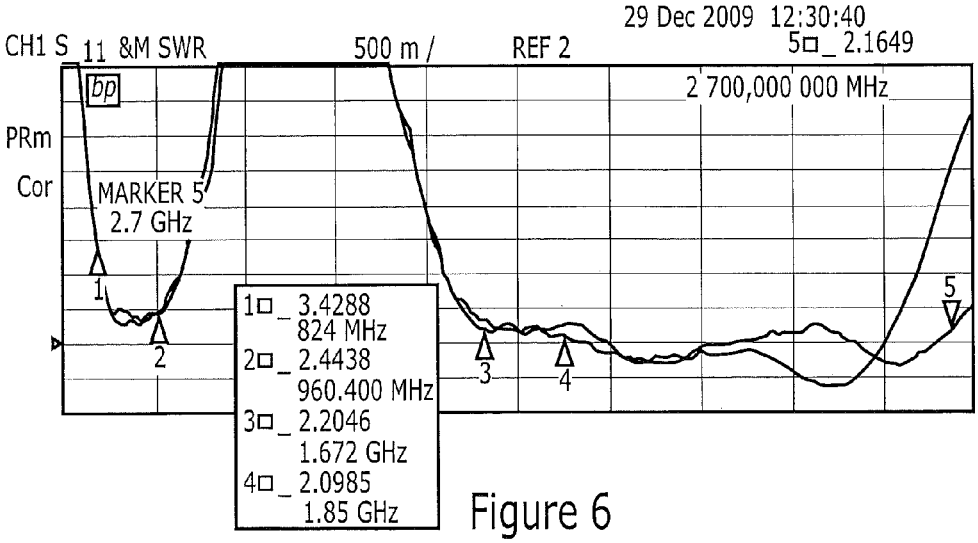
Figure 7:
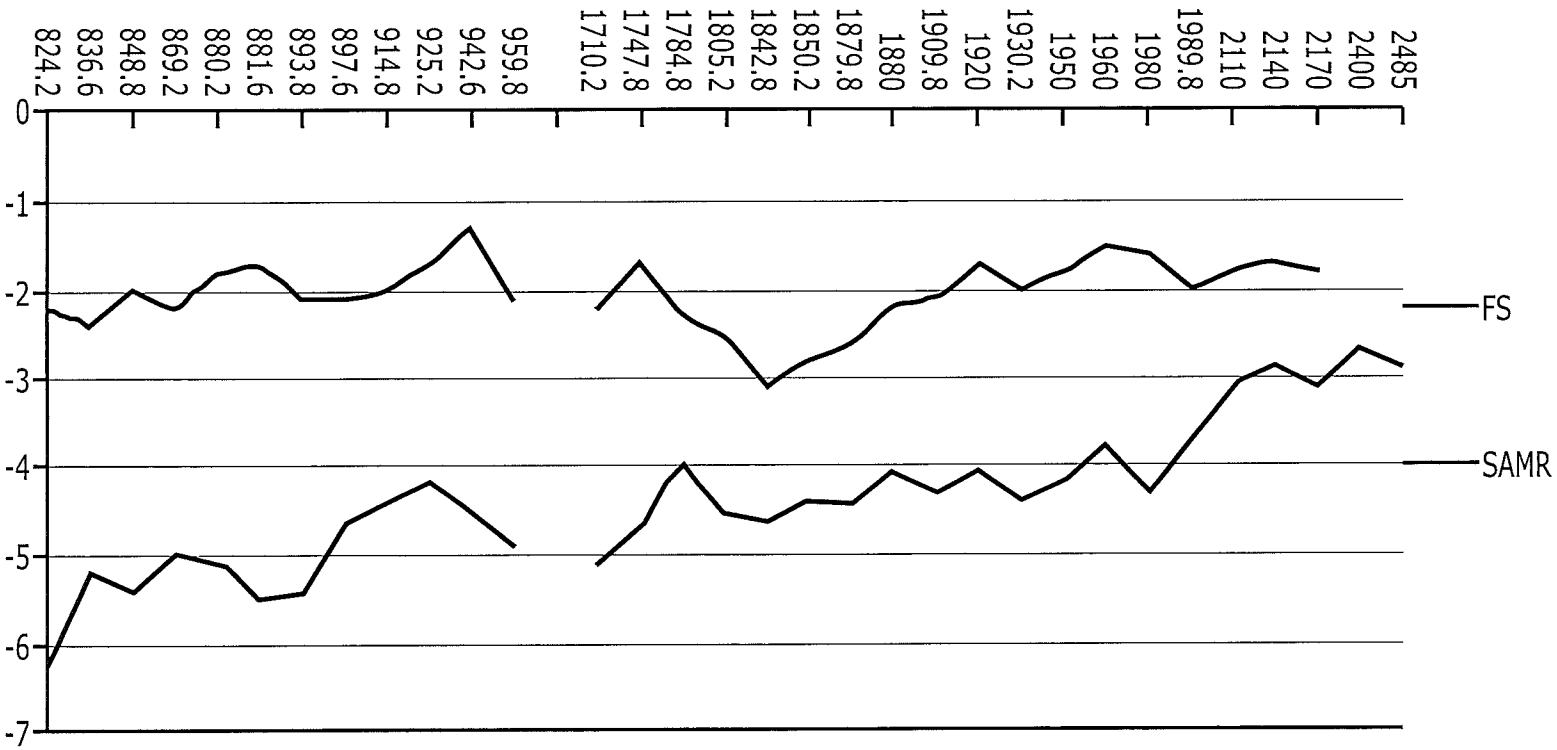
FIGS. 7 and 8 are graphs illustrating performance characteristics of antennas according to some embodiments of the present invention.

FIG. 6 is a graph illustrating gain of a three branch antenna according to embodiments of the present invention in freespace (FS) and against a phantom head (SAMR) with 2 mm separation between the PCB including the ground plane and the phantom head. Gain was only measured up to 2.45 GHz, but the inventor believes that similar performance may extend to 2.7 GHz and likely further. While adding chip components with additional DC resistance may be expected to negatively impact gain, antenna structures that were measured to provide the graph of FIG. 7 used multi-layer inductors, and FIG. 7 shows that the resulting gains are good. For example, the higher portions of the high band that go through the inductive matching element have higher gain than the lower portions of the high band (which do not rely on the inductive matching element). Accordingly, resistive losses (due to the inductive matching element) may be more than offset by improved radiation efficiency and directivity of the radiating element.

Figure 8:
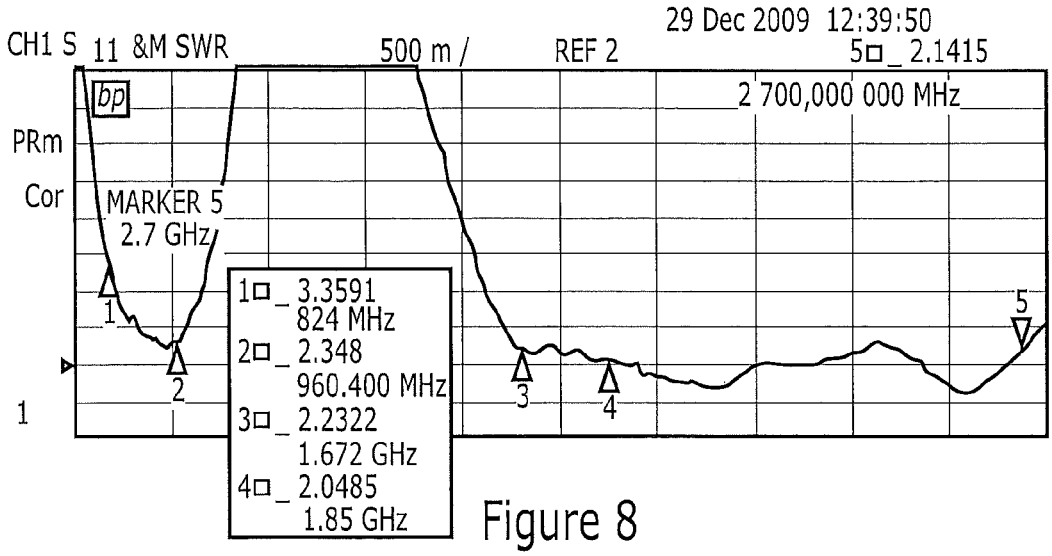

According to some embodiments of the present invention, antenna branch 221 may be configured to resonate at frequencies in the range of about 2 GHz to about 2.3 GHz, antenna branch 231 may be configured to resonate at frequencies in the range of about 1.7 GHz to about 2.0 GHz, and antenna branch 241 may be configured to resonate at frequencies in the range of about 824 MHz to about 960 MHz and at frequencies in the range of about 2.3 to about 2.7 GHz to provide the antenna characteristics shown in FIG. 8. Accordingly, antenna structures (e.g., antenna 105 of FIG. 1) according to some embodiments of the present invention may be configured to efficiently cover frequency bands from about 824 MHz to about 960 MHz and from about 1710 MHz to about 2700 MHz in a compact structure. Antenna structures according to some embodiments of the present invention may thus be configured to operate at GSM frequency bands (e.g., at about 880 MHz to about 960 MHz), DCS frequency bands (e.g., at about 1710 MHz and 1880 MHz), GPS frequency bands (at about 1.575 GHz), AMPS frequency bands (e.g., at about 824 MHz to about 894 MHz), PCS frequency bands (at about 1850 MHz to about 1990 MHz), BlueTooth (BT) frequency bands (e.g., at about 2400 MHz to about 2485 MHz), band 7 (e.g., at about 2500 MHz to about 2570 MHz), band 38

(e.g., at about 2570 MHz to about 2620 MHz), and/or band 40 (e.g., at about 2300 MHz to about 2400 MHz).

Many alterations and modifications may be made by those having ordinary skill in the art, given the benefit of present disclosure, without departing from the spirit and scope of the invention. For example, antennas according to embodiments of the invention may have various shapes, configurations, and/or sizes and are not limited to those illustrated. Therefore, it must be understood that the illustrated embodiments have been set forth only for the purposes of example, and that it should not be taken as limiting the invention as defined by the following claims. The following claims are, therefore, to be read to include not only the combination of elements which are literally set forth but all equivalent elements for performing substantially the same function in substantially the same way to obtain substantially the same result. The claims are thus to be understood to include what is specifically illustrated and described above, what is conceptually equivalent, and also what incorporates concepts of the invention.

That which is claimed is:

1. A communications structure comprising:

a ground plane;

a ground conductor electrically coupled to the ground plane;

a feed conductor;

a first antenna branch electrically coupled to the ground conductor, wherein an electrical coupling between the first antenna branch and the ground conductor is spaced apart from an electrical coupling between the ground plane and the ground conductor;

a second antenna branch electrically coupled to the feed conductor, wherein the first and second antenna branches are spaced apart; and an impedance matching line electrically coupled between the ground plane and the second antenna branch, wherein a segment of the impedance matching line is spaced apart from the ground conductor, wherein the feed conductor comprises an inner conductor of a coaxial RF feed structure, and wherein the ground conductor comprises an outer conductor of the coaxial RF feed structure so that a portion of the ground conductor surrounds a portion of the feed conductor, wherein the ground conductor and feed conductor are spaced apart from the ground plane.

2. A communications structure according to claim 1 wherein a segment of the first antenna branch is parallel with respect to and spaced apart from the ground conductor.

3. A communications structure according to claim 2 wherein the second antenna branch includes a first segment orthogonal with respect to the segment of the first antenna branch and a second segment parallel with respect to the segment of the first antenna branch.

4. A communications structure according to claim 1 wherein a length of the second antenna branch is greater than a length of the first antenna branch.

5. A communications structure according to claim 1 further comprising:

a third antenna branch electrically coupled to the feed conductor, wherein a segment of the third antenna branch is parallel with respect to a segment of the first antenna branch.

6. A communications structure according to claim 5 wherein the third antenna branch includes first and second segments coupled through an impedance matching element, and wherein a length of the third antenna branch including the first and second segments is greater than a length of the second antenna branch.

7. A communications structure according to claim 6 wherein the ground plane, the ground conductor, and the second antenna branch are provided in a first plane, and wherein the first and third antenna branches are provided in a second plane spaced apart from the first plane.

8. A communications structure according to claim 6 wherein the first, second, and third antenna branches are confined within a volume of no more than about 60 mm by 10 mm by 10 mm.

9. A communications structure according to claim 6 wherein the third antenna branch is configured to resonate at frequencies less than about 960 MHZ and at frequencies greater than about 2.3 GHz.

10. A communications structure according to claim 1 wherein the first antenna branch is configured to resonate at frequencies in a range of about 2 GHz to about 2.3 GHz.

11. A communications structure according to claim 1 wherein the second antenna branch is configured to resonate at frequencies in a range of about 1.7 GHz to about 2.0 GHz.

12. A communications structure according to claim 1 wherein a length of the impedance matching line is at least about 10 mm.

13. A communications structure according to claim 12 wherein a cross-sectional current conduction area of the ground conductor is at least twice a cross-sectional current conduction area of the impedance matching line.

14. A communications structure according to claim 12 wherein a width of the impedance matching line is no more than about 1.5 mm.

15. A communications structure according to claim 12 wherein a the segment of the impedance matching line is parallel with respect to the ground conductor, and wherein the segment of the impedance matching line is spaced apart from the ground conductor by at least about 2 mm.

16. A communications structure according to claim 1 wherein the coaxial RF feed structure including the inner and outer conductors provides 50 ohm impedance.

17. A communications structure according to claim 1 wherein a length of the outer conductor of the coaxial RF feed structure is in the range of about 3 mm to about 25 mm.

18. A communications structure according to claim 1 further comprising:

an RF transceiver including an RF transmitter coupled to the feed conductor and an RF receiver coupled to the feed conductor;

a user interface including a speaker and a microphone; and a processor coupled between the user interface and the transceiver, wherein the processor is configured to receive radiotelephone communications through the receiver and to reproduce audio communications using the speaker responsive to the received radiotelephone communications and to generate radiotelephone communications for transmission through the transmitter responsive to audio input received through the microphone.

19. A communications structure according to claim 18 further comprising:

a printed circuit board (PCB) including electrically conductive traces provided at different planes thereof, wherein portions of the processor, user interface, and/or transceiver are implemented as electronic components provided on the printed circuit board, and wherein the ground plane is provided as an electrically conductive layer at one or more planes of the printed circuit board.

* * * * *

UNITED STATES PATENT AND TRADEMARK OFFICE

CERTIFICATE OF CORRECTION

PATENT NO. : 8,456,366 B2
APPLICATION NO. : 12/767162
DATED : June 4, 2013
INVENTOR(S) : Vance It is certified that error appears in the above-identified patent and that said Letters Patent is hereby corrected as shown below:

In the Claims:

Column 12, Claim 15, Line 32: Please correct "wherein a the segment"
to read -- wherein the segment --

Signed and Sealed this
Twentieth Day of May, 2014

Michelle K. Lee

Michelle K. Lee
*Deputy Director of the United States Patent and Trademark Office*